US008327909B2

(12) United States Patent
Knechten

(10) Patent No.: US 8,327,909 B2
(45) Date of Patent: Dec. 11, 2012

(54) PROCESS FOR CASTING A METAL MELT

(75) Inventor: Jörg Knechten, Stadtallendorf (DE)

(73) Assignee: Fritz Winter Eisengiesserei GmbH & Co. KG, Stadtallendorf (DE)

( * ) Notice: Subject to any disclaimer, the term of this patent is extended or adjusted under 35 U.S.C. 154(b) by 159 days.

(21) Appl. No.: 12/529,683

(22) PCT Filed: Jul. 4, 2008

(86) PCT No.: PCT/EP2008/058723

§ 371 (c)(1),
(2), (4) Date: Mar. 5, 2010

(87) PCT Pub. No.: WO2009/004090

PCT Pub. Date: Jan. 8, 2009

(65) Prior Publication Data

US 2010/0155010 A1 Jun. 24, 2010

(30) Foreign Application Priority Data

Jul. 5, 2007 (DE) ..... 10 2007 031 448

(51) Int. Cl.
*B22C 3/00* (2006.01)
*B22C 9/02* (2006.01)

(52) U.S. Cl. ..... 164/72; 164/138; 164/14; 164/16

(58) Field of Classification Search ..... 164/72, 164/138, 14, 16, 33, 55.1, 57.1, 349
See application file for complete search history.

(56) References Cited

U.S. PATENT DOCUMENTS

| | | | | |
|---|---|---|---|---|
| 2,786,771 | A * | 3/1957 | Waterhouse et al. | 106/38.28 |
| 3,938,578 | A | 2/1976 | Epstein et al. | 164/16 |
| 4,550,761 | A * | 11/1985 | Moore | 164/14 |

FOREIGN PATENT DOCUMENTS

| | | | |
|---|---|---|---|
| DE | 2 407 344 | | 8/1974 |
| EP | 1 752 552 | A1 * | 2/2007 |
| EP | 1752552 | | 2/2007 |
| JP | 55149747 | | 11/1980 |
| JP | 57171540 | | 10/1982 |
| JP | 59094550 | | 5/1984 |
| JP | 60040644 | | 3/1985 |

OTHER PUBLICATIONS

International Search Report for International Application No. PCT/EP2008/058723, mailed Oct. 7, 2008.

* cited by examiner

*Primary Examiner* — Kevin P Kerns
(74) *Attorney, Agent, or Firm* — The Webb Law Firm

(57) ABSTRACT

A method for the casting of cast parts from an iron melt forming vermicular or spheroidal graphite, includes casting iron melt into a casting mold, which includes at least one casting mold part, which is formed from a mold material, which is mixed from a sand-type basic material and an organic binder, and then gassed with a gas containing sulphur in order to harden the binder, such that a mold part of stable form is obtained. The method provides embodiments in which molds produced in accordance with the $SO_2$ process enable the risk of occurrence of local microstructure degeneration in the cast part to be reduced to a minimum. This is achieved in that, after the hardening of the mold part and before the casting, at least one of the surfaces, which comes into contact with the iron melt, is provided with a coating containing a non-volatile sulphide former.

9 Claims, 1 Drawing Sheet

PROCESS FOR CASTING A METAL MELT

CROSS-REFERENCE TO RELATED APPLICATIONS

This application is a National Phase Application of International Application No. PCT/EP2008/058723, filed on Jul. 4, 2008, which claims the benefit of and priority to German patent application no. DE 10 2007 031 448.7, filed on Jul. 5, 2007. The disclosures of the above applications are incorporated herein by reference in their entirety.

FIELD OF THE INVENTION

The invention relates to a method for the casting of cast parts from an iron melt forming vermicular or spheroidal graphite, in which the iron melt is cast into a casting mold, which comprises at least one casting mold part which is formed from a mold material, which is mixed from a sand-type basic material and an organic binder, and then gassed with a gas containing sulphur, in particular $SO_2$ gas, in order to harden the binder of the mold material, such that a mold part of stable form is obtained.

BACKGROUND

The casting mold parts of the type described above typically involve in practice what are referred to as "casting cores", with which cavities such as channels, hollows, etc., or cut-out apertures with undercuts and comparable complex shapes are formed on the part to be cast. When the finished hardened cast part is removed from the individual casting mold, the casting mold parts concerned are destroyed. In this situation they decompose into fragmentary individual pieces, which can be conveyed out of the cast part mechanically, for example by vibration, or with the aid of a flushing fluid.

Casting cores of this type are used both in casting molds, of which the outer parts are designed as fixed permanent molds, as well as in what are referred to as "lost casting molds". With lost casting molds, not only the casting cores but also the outer mold parts, surrounding the cast part on the outside, are made of mold material and are accordingly likewise totally destroyed when the individual cast part is removed from the mold.

There are various possibilities known for producing lost mold parts (casting cores and outer mold parts) for casting molds. In this context, a distinction is made between what are referred to "cold-box processes" and "hot-box processes". While the hot-box processes are based on the use of mold materials containing an inorganic binder, the cold-box processes have the common factor that the mold material, mixed from mold sand and an organic binder, is gassed with a gas after being filled into the mold box forming the casting to be produced in each case. The gas passing through the mold material in this situation reacts chemically with the respective binder and so causes it to harden.

One variant of the cold-box process is the $SO_2$ process. With this process, the mold material being processed in each case is mixed from mold sand and a resin binder, which may be, for example, a furan-phenol or epoxy resin binder. During the gassing of a mold material composed in this manner with $SO_2$, the resin binder hardens due to reaction with the sulphuric acid which forms from sulphur dioxide, oxygen, and water.

The $SO_2$ process is used to a great extent in practice, since mold materials which can be solidified with sulphur dioxide have good flowing properties in the non-solidified state, and therefore inherently have particularly good mold filling capacities. These mold materials are therefore well-suited in particular for the production of filigree-shaped outer parts and cores for casting molds. In addition, the mold materials which can be solidified with sulphur dioxide can be kept for long periods without any special precautions and after gassing with the sulphur dioxide gas have a high degree of mold stability.

Practical experience in the casting of cast iron in casting molds produced in the $SO_2$ process has shown, however, that the cast parts obtained in this situation frequently have undesirable degeneration of the graphite formed in the cast part obtained in this way. This observation related in particular to castings which were cast from an iron melt treated with magnesium.

As described in detail, for example, in EP 1 752 552 B1, cast iron can itself undergo a magnesium treatment immediately before entering the casting mold or while still in the casting mold. The magnesium introduced in this process forms compounds with other constituents of the cast iron or with elements likewise additionally introduced, which serve as nuclei for the formation of the graphite type desired in each case. Accordingly, by suitable additions of magnesium, optimized casting results can be achieved in the production of spheroidal graphite ("GJS"), in which the graphite is present in a spheroidal form, or vermicular graphite ("GJV"), in which the graphite is present in a worm-like shape.

Cast iron with spheroidal graphite has typical strength values from 350 MPa to 1000 MPa, while the strength of cast iron with vermicular graphite lies in the range from 350 MPa to 500 MPa. The particular advantage of vermicular graphite in this situation lies in a favorable combination of high strength and good thermal conductivity, as well as good damping behavior. Cast iron with lamellar-shaped graphite ("GJL"), by contrast, has strength values in the range from 150 MPa to 350 MPa.

It has been observed on cast parts from magnesium-treated cast iron melts manufactured from GJS or GJV in casting molds with $SO_2$-hardened outer parts or casting cores that the graphite in locally delimited sections close to the surface was not present in the expected spheroidal or vermicular form but in lamellar form. This deviation from the formation of graphite actually being striven for leads to locally sharply deviating properties of the cast part, as a result of which the quality of thin-walled parts can be severely impaired.

SUMMARY OF THE INVENTION

Against this background, the invention was based on an aspect of providing embodiments in which with casting molds manufactured according to the $SO_2$ process, the risk of the occurrence of local graphite and microstructure degeneration in the cast part during the casting of iron melts forming spheroidal or vermicular graphite can be reduced to a minimum.

A method of casting cast parts from an iron melt forming vermicular or spheroidal graphite according to a first embodiment of the invention includes casting the iron melt into a casting mold, which comprises at least one casting mold part which is formed from a mould material, which is mixed from a sand-type basic material and an organic binder, and then gassed with a gas containing sulphur, in particular SO2 gas, in order to harden the binder of the mold material, such that the at least one mold part is stably formed; wherein after the hardening of the at least one mold part and before casting of the iron melt, at least one of the surfaces, which comes into contact with the iron melt when the iron melt is poured into the casting mold is provided with a coating containing a non-volatile sulphide former.

Without wishing to be bound by theory, variants of the invention are based on the belief that at least the surface of a casting mold part, mixed from a sand-type basic material and an organic binder and hardened by gasification with sulphur-containing gas, in particular $SO_2$ gas, which comes into contact with the metal casting melt when the metal casting melt is poured into the casting mold assembled with the use of the mold part, is to be provided with a coating containing a non-volatile sulphide former.

The invention is based on the recognition that with the casting mold parts used in the prior art, hardened with the use of $SO_2$ gas, as a consequence of the heating accompanying pouring in of the hot melt, vapors or gases containing sulphur emerge from the casting mold parts and penetrate in the direction of the mold cavity surrounded by the mold. There they impinge on the cast metal filled into the mold cavity and react with the constituents contained in it.

These reactions lead, for example with cast iron melts treated with magnesium, to the creation of magnesium sulphide gathering close to the surface. The magnesium bound in this way can then no longer develop its nucleus-forming effect in the cast iron, with the consequence that it is not the desired graphite form which is produced but a degenerated graphite form with perceptibly poorer mechanical properties.

With a casting mold composed of parts coated in accordance with the invention, the risk is obviated of specific constituents of the metal cast in each case being rendered ineffective due to the coating containing a sulphide binder applied onto the critical surfaces of the casting in question. With a casting mold part coated according to the invention, the gas containing sulphur surging from the casting mold part impinges on the coating provided according to the invention and reacts with the sulphide former contained in it to form a sulphide. In this bound state, the sulphur has no effect on the metal melt cast in each case.

The invention makes use in this way of a possibility already inherently known from DE-OS 2 407 344 (U.S. equivalent U.S. Pat. No. 3,938,578), of coating a casting mold part on its surface with a compound which is capable of binding or adsorbing an acidic gas flowing through the casting mold part. As a departure from the prior art, in which the application of the coating has the purpose of binding gaseous, acidic catalysts contained in the individual mold part in order in this way to avoid the emergence of gases, harmful to health or highly corrosive, the invention, however, makes provision for the use of a coating related to a quite specific problem, namely the emergence of graphite degeneration in the cast part.

Accordingly, the coating provided according to the invention contains a sulphide former, which prevents the magnesium contained in the melt cast according to the invention from entering into a combination with the gas containing sulphur emerging from the casting mold part.

With the invention it is therefore possible, in a simple manner, even in casting molds assembled with the use of casting mold parts manufactured in accordance with the $SO_2$ process, to produce high quality cast parts in which the risk of occurrence of local microstructure degeneration is reduced to a minimum.

Practical experiments have revealed in this context that the invention has a positive effect in particular in connection with the casting of iron casting melts forming spheroidal or vermicular graphite. It has been demonstrated, for example, that, after the application of the coating composed according to the invention onto the surfaces of the casting mold coming into contact with the iron casting melt to be cast in each case, no microstructure degeneration occurs even if the iron casting melt of comparably high magnesium content has previously been subjected to a treatment with an agent containing magnesium.

In this connection, it has turned out to be particularly effective in practice if the coating applied, in the manner according to the invention, onto the individual casting mold part contains as the sulphide former an alkali carbonate or earth alkali carbonate. In practical experiments, coatings obtained and applied in accordance with the invention have proved particularly valuable if they contained calcium carbonate ($CaCO_3$) which reacts with the sulphur to form CaS.

The sulphides formed from the alkali or earth alkali carbonates behave, in particular when an iron cast melt is cast as the cast metal, on the one hand in a neutral manner and, on the other bind the sulphur emerging from the mold material in gaseous form during the casting process and penetrating in the direction of the mold cavity of the individual casting mold, such that this can no longer exert any influence on the constituents of the individually cast metal melt.

It is also conceivable for the coating applied according to the invention to contain, as the sulphide former, an alkali hydrogen carbonate, such as sodium hydrogen carbonate ($NaHCO_3$). These substances likewise form sulphides with the sulphur emerging from the casting mold part, such as $Na_2S$, and thereby prevent the sulphur from reacting with a constituent of the individual cast metal.

Moreover, the sulphide former contained in a coating according to the invention can be ammonium carbonate or ammonium hydrogen carbonate. With sulphur these substances form ammonium sulphides.

It is basically advantageous if the surfaces of all casting mold parts produced by the $SO_2$ process coming into contact with the individual metal melt are coated in the manner according to the invention. With casting molds formed completely as lost molds, this also relates to the outer parts of the casting mold, by which the mold cavity of the mold is delimited at its outer sides.

The invention has a particularly advantageous effect, however, if the casting mold part coated according to the invention is a casting core. Such casting cores are, as a rule, essentially entirely surrounded by the metal cast into the casting mold, such that the gas emerging from the core penetrates strongly into the adjacent cast material.

BRIEF DESCRIPTION OF THE DRAWINGS

The invention is described in greater detail hereinafter on the basis of drawings representing embodiments. These show, in diagrammatic form.

DETAILED DESCRIPTION

Figure 1:
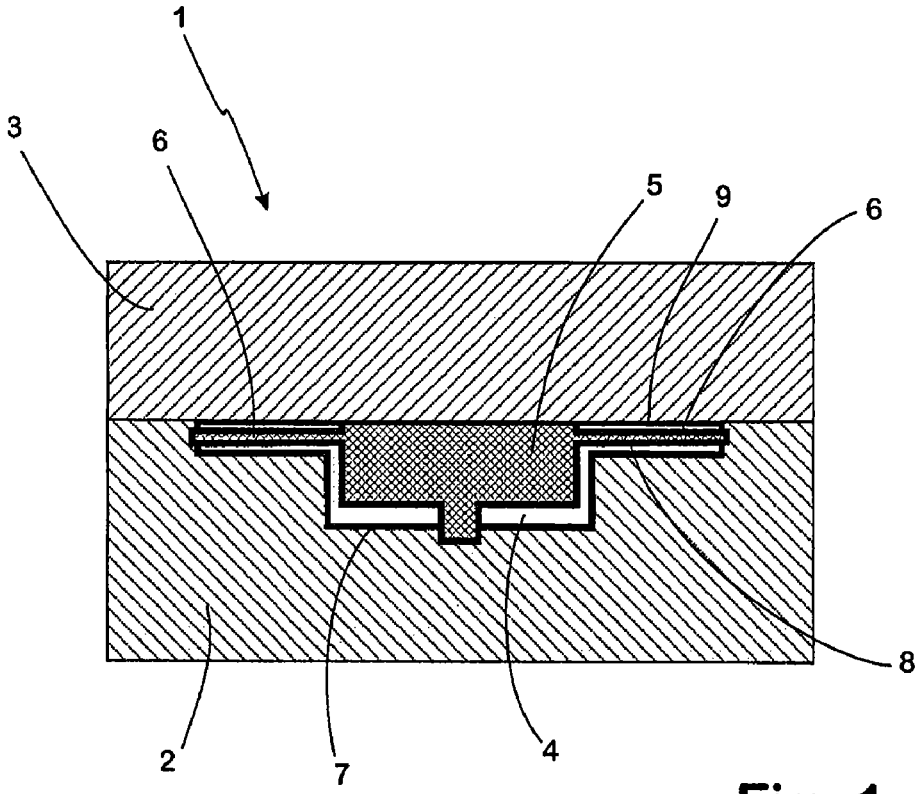
FIG. 1 A casting mold in the unfilled state, in a cross-section.
Figure 2:
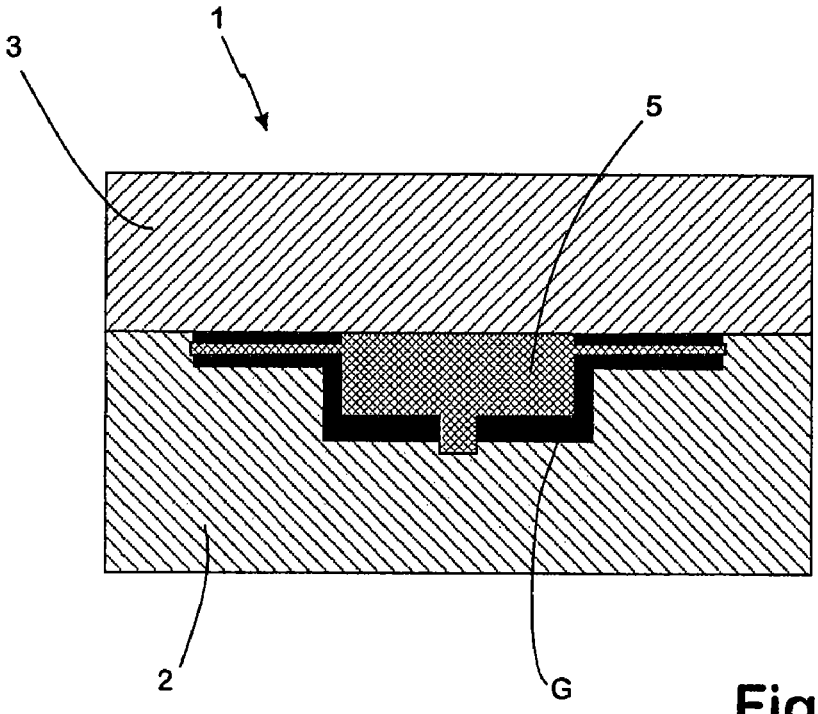
FIG. 2 The casting mold in the filled state.

The casting mold 1 for casting a cast part G from an iron melt treated with magnesium, in this case relating to a brake disk, has a lower, outer mold part 2 and an upper, outer mold part 3 lying on the lower mold part 2 and covering it.

A mold cavity 4 is molded into the mold part 2 from its surface facing the upper mold part 3, which delimits the outer circumferential surfaces, the outer face surface of the pot element, and the friction surface, facing the outer face surface of the pot element, of the friction ring of the brake disk cast part G to be produced. The other friction surface of the friction ring and the inner circumferential surfaces of the pot element of the cast part G are formed by a casting core 5, which is inserted into the mold cavity 4.

Formed on the casting core 5 are projections 6, distributed in star fashion at equal angle intervals at its circumference, which extend into the ring-shaped section of the mold cavity 4, provided for the friction ring of the cast part G to be cast, and are located with their free ends in correspondingly shaped cut-out apertures of the lower mold part 2, in this case only individually indicated. The projections 6 form in the cast part G cooling channels leading radially from the inner side of its pot to the outer circumferential surface of the friction ring.

The outer mold parts 2, 3 and the casting core 5, with its projections 6 formed as one part with it, are produced from a mold material which consists of a sand-type basic mold material and an organic resin binder mixed with the basic mold material. In order to produce the mold parts 2, 3 and the casting core 5 with the projections 6, this mold material is filled in an inherently known manner into a mold box, not shown here, and compacted. Next, the mold material filled into the mold box is gassed with $SO_2$ gas. In this situation a chemical reaction takes place between the resin binder and the sulphur dioxide gas, as a result of which the resin binder is hardened.

After completion of the hardening process, the stable shaped casting mold parts (outer mold parts 2, 3 and casting core 5 with its projections 6) obtained in this way are coated on their surfaces coming into contact with the melt (inner surfaces of the mold cavity 4, outer surfaces of the casting core 5 and its projections 6, as well as sections, covering the mold cavity 4, of the surface of the upper outer mold part 3 facing the lower mold part 2) with a coating 7, 8, 9 applied in the form of a dressing or wash, containing calcium carbonate as a sulphide former. While calcium carbonate, an earth alkali carbonate, is utilized in this embodiment as the sulphide former, other sulphide formers, such as, for example, alkali hydrogen carbonate, ammonium carbonate, or ammonium hydrogen carbonate, can be utilized.

To produce the cast part G, the cast iron, treated with magnesium immediately before entering the casting mold 1, is cast via the casting basin, not shown, into the casting mold 1 and flows via channels, likewise not shown, into the mold cavity 4 until this is completely filled with cast iron.

Substantial heating of the areas of the casting mold 1 coming into contact with the cast iron is involved when the cast iron enters the casting mold 1. As a consequence of this heating, due to the unavoidable residual moisture present in the mold parts 2, 3 and 5, vapors containing sulphur are formed and then permeate in the casting mold 1, in the process also penetrating in the direction of the mold cavity 4.

There they impinge on the coating 7, 8, 9 containing $CaCO_3$ as the sulphide former. The sulphur then reacts with the $CaCO_3$ to form CaS and is bound in the coating 7. The penetration of the cast iron, filled into the mold cavity, with sulphur is in this way effectively suppressed, such that the cast iron can solidify uniformly over its entire volume, with the formation of the desired graphite form. The risk of the occurrence of degenerated graphite no longer exists.

REFERENCE SYMBOLS

1 Casting mold
2 Lower outer mold part of the casting mold 1
3 Upper outer mold part of the casting mold 1
4 Mold cavity
5 Casting core
6 Projections
7, 8, 9 Coating containing a sulphide former
G Cast part

What is claimed is:

1. Method for casting of cast parts from an iron melt forming vermicular or spheroidal graphite, in which the iron melt is cast into a casting mold, which comprises at least one casting mold part which is formed from a mold material, which is mixed from a sand-type basic material and an organic binder, and then gassed with a gas containing sulphur in order to harden the binder of the mold material, wherein after the hardening of the at least one mold part and before the casting of the iron melt, at least one of the surfaces, which comes into contact with the iron melt when the iron melt is poured into the casting mold, is provided with a coating containing a non-volatile sulphide former.

2. Method according to claim 1, wherein the sulphide former is an alkali carbonate.

3. Method according to claim 1, wherein the sulphide former is an earth alkali carbonate.

4. Method according to claim 3, wherein the earth alkali carbonate is calcium carbonate.

5. Method according to claim 1, wherein the sulphide former is an alkali hydrogen carbonate.

6. Method according to claim 1, wherein the sulphide former is ammonium carbonate.

7. Method according to claim 1, wherein the sulphide former is ammonium hydrogen carbonate.

8. Method according to claim 1, wherein the mold part is a casting core.

9. Method according to claim 1, wherein the iron melt is subjected to a magnesium treatment.

* * * * *